US006512450B1

(12) United States Patent
Burnett et al.

(10) Patent No.: US 6,512,450 B1
(45) Date of Patent: Jan. 28, 2003

(54) EXTRA LOUD LOW FREQUENCY ACOUSTICAL ALARM ASSEMBLY

(75) Inventors: George Alan Burnett, Clayton, IN (US); Christopher Michael Baldwin, Indianapolis, IN (US)

(73) Assignee: Mallory Sonalert, Products, Inc., Indianapolis, IN (US)

( * ) Notice: Subject to any disclaimer, the term of this patent is extended or adjusted under 35 U.S.C. 154(b) by 0 days.

(21) Appl. No.: 09/488,693

(22) Filed: Jan. 20, 2000

(51) Int. Cl.[7] ..... G08B 3/00

(52) U.S. Cl. ..... 340/384.1; 340/384.6; 381/339; D10/120

(58) Field of Search ..... 340/384.1, 384.6, 340/384.4; 381/338, 339; D10/120, 119

(56) References Cited

U.S. PATENT DOCUMENTS 1,590,814 A * 6/1926 Durett
3,815,129 A 6/1974 Sweany
4,213,121 A 7/1980 Learn et al.
4,429,247 A * 1/1984 Feldman ..... 310/322
5,406,637 A * 4/1995 Gonzalez ..... 381/154
5,675,312 A 10/1997 Burnett
5,872,506 A 2/1999 O'Brien et al.
5,990,784 A 11/1999 Burnett

OTHER PUBLICATIONS

Mallory, SONALERT electric audible signals: It's uses are limited only by your imagination (product catalog).

* cited by examiner

*Primary Examiner*—Julie Lieu
(74) *Attorney, Agent, or Firm*—Niro, Scavone, Haller & Niro

(57) ABSTRACT

The invention is an improved piezoelectric noise-making and audible signaling device which produces a distinctive 2 KHz tone that is more pronounced and significantly easier to perceive, especially in a noisy environment. The volume of the audible tone is amplified by using two or three sound-amplifying chambers or cavities.

6 Claims, 3 Drawing Sheets

EXTRA LOUD LOW FREQUENCY ACOUSTICAL ALARM ASSEMBLY

BACKGROUND OF THE INVENTION

The present invention relates to an improved noise-making device used to provide audible alarms in a wide variety of devices including, for example, automobiles and trucks, industrial equipment, medical devices, traffic signals, appliances and the like. Such devices can use a piezoelectric transducer and associated circuitry to produce sound at a given frequency. The transducer flexes in response to an applied voltage. If an oscillating voltage is applied to the transducer at an appropriate rate, the flexing of the transducer produces an audible sound of substantial volume. Prior devices produce an audible sound at 3 KHz.

In the invention, the sound produced is not 3 KHz. Instead, the sound produced is at a lower frequency, 2 KHz, that is more easily heard and distinguished, especially in a noisy environment. A sound at 2 KHz is also more likely to be perceived by more persons than is a sound at 3 KHz, due to the loss of hearing as the normal person ages. In another feature of the invention, multiple sound cavities amplify in stages the sound produced by the transducer, making it considerably louder and easier to hear.

U.S. Pat. No. 5,990,784 "Schmitt Trigger Loud Alarm With Feedback," is incorporated by reference herein and describes an alarm device using a piezoelectric transducer. This patent is owned by the assignee of the present invention.

SUMMARY OF THE INVENTION

According to the invention, there is provided a piezoelectric transducer and associated electrical circuitry to cause the transducer to oscillate at a resonant audible frequency. The transducer is mounted to a proximal tubular housing which is hollow, thus providing a first cavity. A second or distal tubular housing forms a second cavity adjoining the first cavity, and is of larger diameter than the first cavity. A third cavity adjoining the second cavity may optionally be employed. Sound is produced by the transducer and passes through the first cavity, second cavity and, if used, the third cavity. The sound is through a grill on the last cavity. The invention provides an audible sound at 2 KHz by means of an amplifier circuit including feedback from the transducer to the amplifier. The transducer resonates, producing an audible sound at 2 KHz. The cavities cause the sound to be greatly amplified when compared to similar devices not using multiple cavities.

DETAILED DESCRIPTION OF THE INVENTION

Figure 1:
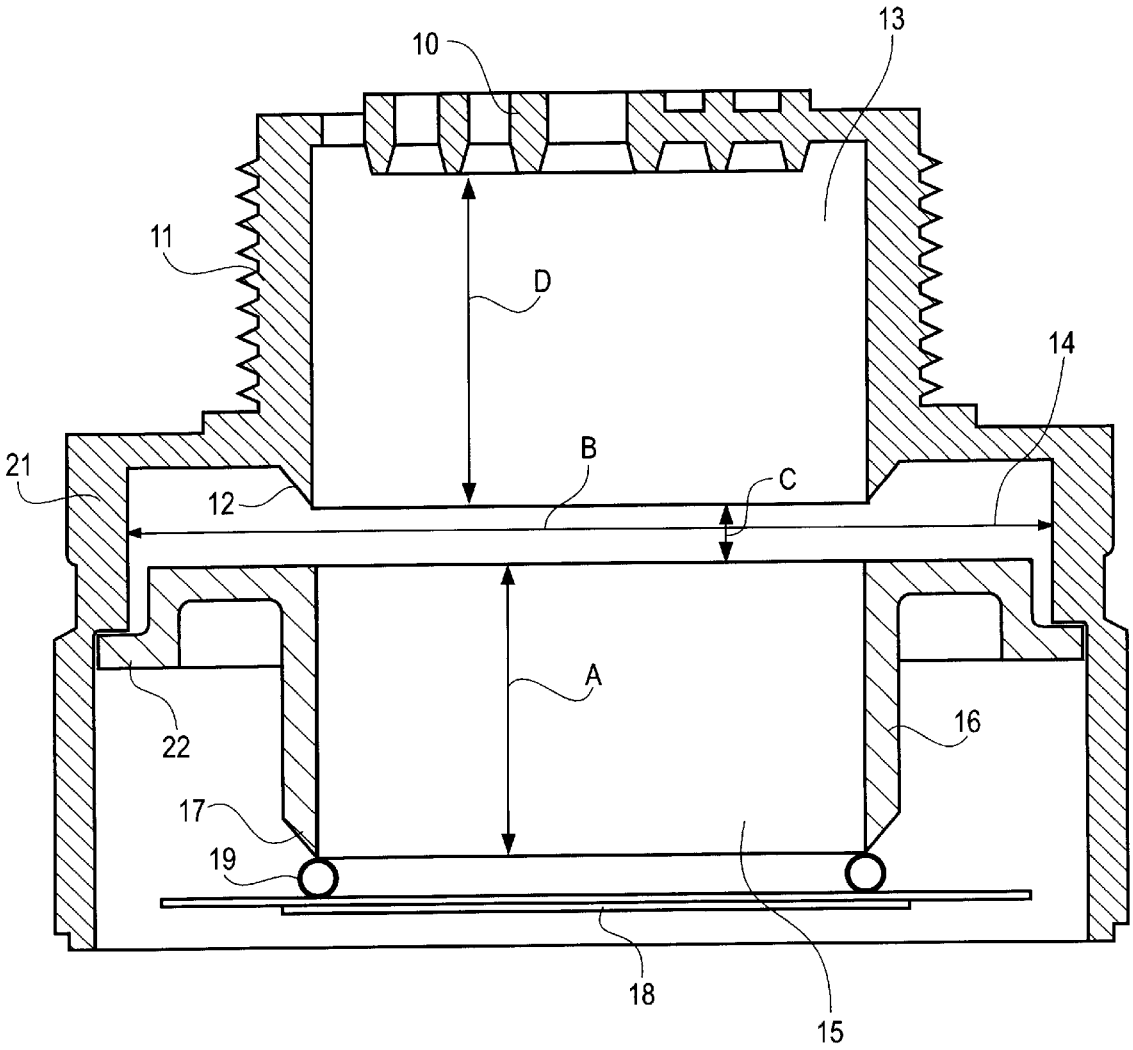
FIG. 1 is a cross-section of the noise-making device.
Figure 2:
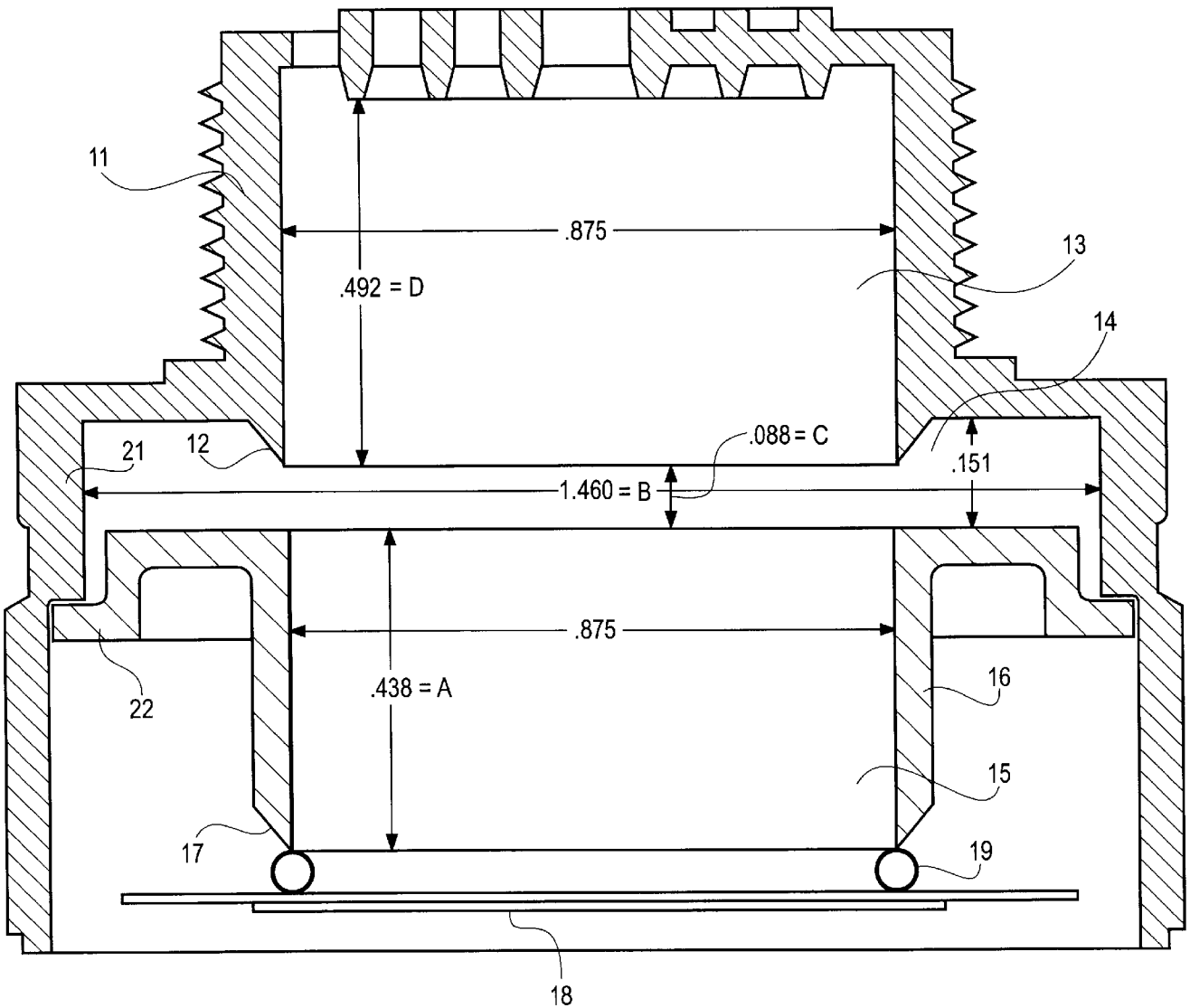
FIG. 2 is another cross-section of the noise-making device including dimensions that have been determined to optimize the amplification.

Referring now to FIGS. 1 and 2, there is shown a piezoelectric transducer 18. Transducer 18 is mounted at its nodal diameter to a knife-edge 17 at an end of a housing insert 16. Adhesive 19 binds the transducer 18 to the knife-edge 17. Knife-edge 17 supports the transducer 18 while at the same time allowing the transducer to flex when a voltage is applied to it. Mounting the transducer at its nodal diameter minimizes interference with flexing of transducer 18.

Housing insert 16 is cylindrical in cross-section and hollow, forming a sound-amplifying cavity 15 next to the transducer 18. One suitable material for housing insert 16 is 6/6 nylon or "ABS." A source for 6/6 nylon is Zytel 101 available from Pro Tech Plastic Inc., 1295 West Helena Drive, West Chicago, Ill., 60185. The length "A" of housing 16 is adjusted to maximize the amplification.

A main housing 11 is cylindrical in cross-section and hollow. Main housing 11 is attached to an end of housing insert 16. A flange 21 on main housing 11 engages and is secured by any convenient means to a flange 22 on insert 16. Main housing 11 is hollow, and has two cylindrical sections with different diameters. One cylindrical section forms a sound-amplifying cavity 13, and a second larger cylindrical section forms another sound-amplifying cavity 14. The diameters of cavities 13 and 15 are typically about the same, whereas the diameter "B" of cavity 14 is larger. A grill 10 may be attached to the end of housing 11 away from the transducer 18, and allows sound produced by the transducer, and amplified in the cavities, to be emitted and heard.

FIG. 2 shows the invention with dimensions that have been found to produce a sound increase of about 10 to 15 dbA compared to devices using the same transducer and circuitry, but lacking the housing insert 16 and therefore having only one cavity. Dimension "A" is 0.438 inches. Dimension "B" is 1.460 inches. Dimension "C" is 0.088 inches. Dimension "D" is 0.492 inches. The diameters of housing 11 and housing insert 16 are 0.875 inches, approximately the same as the nodal diameter of transducer 18.

Figure 3:
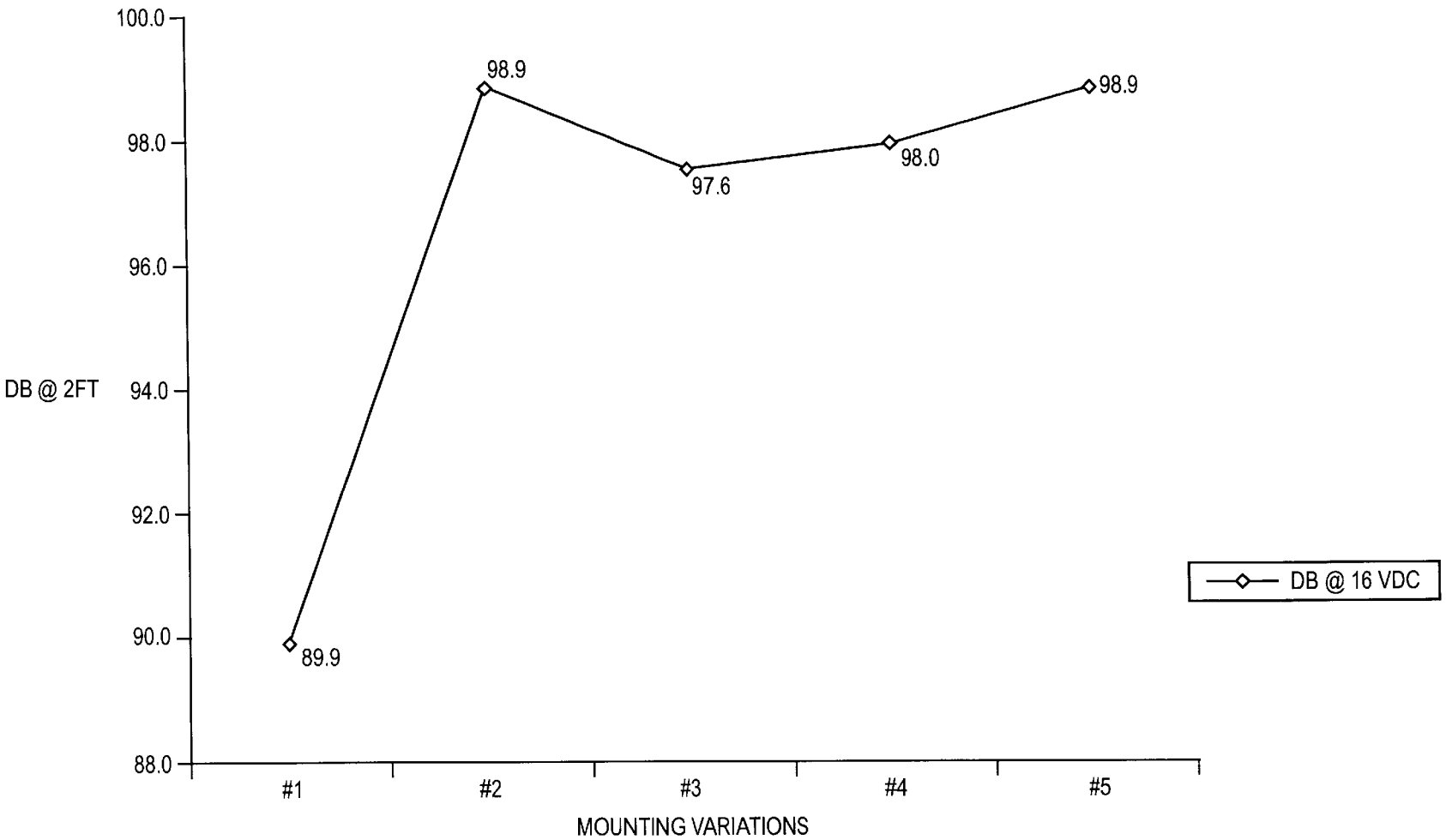
FIG. 3 is a graph showing the increase in sound produced by the invention compared to a devices with different configurations, and all using the same electrical circuit.

FIG. 3 shows the sound levels produced by devices which all use the circuitry shown in the '784 patent, and the following different variations in structure:

#1—Housing insert 16 is omitted, and the transducer 18 is mounted on a knife-edge 12 on main housing 11.

#2—Housing insert 16 and main housing 11 are used, with transducer 18 mounted on knife-edge 17 as shown in FIG. 1.

#3—The same as #2, except that the length of housing insert 16 was reduced by 0.025 inches from the dimension shown in FIG. 2, 0.438 inches.

#4—The same as #2, except that the angle of knife-edge 12 has been increased slightly, from about 40 degrees to about 20 degrees.

#5—The same as #2, except that the diameter "B" of sound-amplifying cavity 14 was decreased by 0.100 inches from the dimension shown in FIG. 2, 1.460 inches.

Use of housing insert 16 causes a large increase in sound produced, from 89.9 dbA to 98.9 dbA. and As can be seen, elimination of the housing insert causes a very significant drop in emitted sound from approximately 97 to 99 dbA to approximately 90 dbA. The maximum increase in sound is achieved by employing three sound-amplifying chambers or cavities, by choosing dimension "A" to be about one-half of the nodal diameter of transducer 18, and by choosing dimension "B" to be roughly one to two times the nodal diameter. Optimum dimensions are readily determined by measuring the sound output of different configurations.

We claim:

1. A noise-making device comprising:

a piezoelectric transducer;

a first sound-amplifying chamber attached to the transducer, the sound-amplifying chamber enclosing a space communicating with the transducer for receiving sound waves from the transducer, the first chamber having a diameter approximately equal to the nodal diameter of the transducer;

a second sound-amplifying chamber enclosing a second space in communication with the space in the first chamber for receiving sound waves from the first chamber, the second chamber having a diameter between approximately 1 and 2 times the diameter of the first chamber; and a third sound-amplifying chamber enclosing a space communicating with the second sound-amplifying chamber and receiving sound waves from the second amplifying chamber, the third chamber having a diameter approximately equal to the nodal diameter of the transducer.

2. A noise-making device comprising:

a piezoelectric transducer;

a hollow housing attached to the transducer, the interior of the housing forming a first sound-amplifying cavity;

a second housing attached to the first housing, the interior of the second housing forming a second sound-amplifying cavity adjacent to the first cavity, and of larger diameter than the first sound-amplifying cavity; and a third sound-amplifying cavity adjacent to the second sound-amplifying cavity, and of substantially the same diameter as the first sound-amplifying cavity.

3. A noise-making device comprising:

a distal tubular member with two open ends;

a proximal tubular member with two open ends, the proximal member being smaller in diameter than the distal member, and the proximal member attached to one end of the distal member so that the space enclosed by of each member is in communication with and adjacent to the other;

a piezoelectric transducer attached to an end of the proximal tubular member away from the distal tubular member, and closing the end of the proximal tubular member; and circuitry for causing the transducer to oscillate at an audible frequency and emit sound waves into the proximal and distal tubular members.

4. The noise-making device of claim 3, wherein the diameter of the distal tubular member is between one and two times the diameter of the proximal tubular member.

5. The noise-making device of claim 3, wherein the length of the proximal tubular member is approximately one-half of the nodal diameter of the transducer.

6. The noise-making device of claim 3, wherein the audible frequency is about 2 KHz.

* * * * *